US008789964B2

(12) United States Patent
Lamm

(10) Patent No.: US 8,789,964 B2
(45) Date of Patent: Jul. 29, 2014

(54) SOLAR-POWERED, ILLUMINATED SUPPORT FOR A DECORATIVE ITEM

(75) Inventor: Timothy A. Lamm, Midlothian, VA (US)

(73) Assignee: Evergreen Enterprises of Virginia, LLC, Richmond, VA (US)

( * ) Notice: Subject to any disclaimer, the term of this patent is extended or adjusted under 35 U.S.C. 154(b) by 257 days.

(21) Appl. No.: 13/355,892

(22) Filed: Jan. 23, 2012

(65) Prior Publication Data

US 2012/0201017 A1 Aug. 9, 2012

Related U.S. Application Data

(60) Provisional application No. 61/439,491, filed on Feb. 4, 2011.

(51) Int. Cl.
*F21V 21/00* (2006.01)

(52) U.S. Cl.
USPC ..... 362/192; 362/153; 362/152; 362/806; 362/431

(58) Field of Classification Search
USPC ..... 362/145, 152, 153, 153.1, 192, 234, 362/253, 410, 413, 431, 432, 806, 812
See application file for complete search history.

(56) References Cited

U.S. PATENT DOCUMENTS

| | | | | |
|---|---|---|---|---|
| 926,426 | A * | 6/1909 | Koch et al. | 248/124.1 |
| 5,584,398 | A * | 12/1996 | Lin | 211/40 |
| 6,015,122 | A | 1/2000 | Qui | |
| 6,079,857 | A * | 6/2000 | Mendelsohn et al. | 362/427 |
| 2003/0161161 | A1 * | 8/2003 | Durkin | 362/431 |
| 2007/0019420 | A1 * | 1/2007 | Farmer | 362/410 |

* cited by examiner

*Primary Examiner* — Laura Tso
(74) *Attorney, Agent, or Firm* — Goodman, Allen & Filetti PLLC; Matthew R. Osenga, Esq.

(57) ABSTRACT

A support for a decorative item includes a stanchion with a first end and a second end. A flexible neck, having a first end and a second end, is connected to the second end of the stanchion at a first end thereof. At least one attachment device lies between the first and second end of the stanchion for attaching a decorative item to the stanchion. A luminary is connected to the second end of the flexible neck to provide illumination to the decorative item.

18 Claims, 5 Drawing Sheets

SOLAR-POWERED, ILLUMINATED SUPPORT FOR A DECORATIVE ITEM

CROSS-REFERENCE TO RELATED APPLICATION(S)

This United States Non-Provisional Patent Application relies for priority on U.S. Provisional Patent Application Ser. No. 61/439,491, filed on Feb. 4, 2011, the contents of which are incorporated herein by reference.

FIELD OF THE INVENTION

The present invention concerns a support or flagpole that includes a solar-powered luminary so that light may be cast upon a flag or other decorative item disposed on the support or flagpole.

DESCRIPTION OF THE RELATED ART

Flagpoles and other supports for decorative items are known in the art. A standard flagpole is affixed either to a horizontal surface (i.e., the ground) or to a vertical surface (i.e., the side of a house).

If the flag owner wishes to light up the flag disposed thereon, the owner typically will focus a light source, independently-powered from the flagpole, onto the flag or decorative item.

Flagpoles and supports for decorative items in the prior art, therefore, typically require separate lighting.

U.S. Pat. No. 6,015,122 (hereinafter "the '122 patent") describes one flagpole that is known in the prior art. As with flagpoles generally, this prior art design provides a location for suspension of a flag but does not provide for any type of illumination.

SUMMARY OF THE INVENTION

In one embodiment, the present invention contemplates a design for a flagpole that provides illumination of a flag disposed thereon. As such, it is contemplated that the flagpole of the present invention will include a luminary disposed at one end, the luminary being adjustable so that light generated thereby may be focused on the flag. The luminary may be a solar powered LED (light emitting diode) device, thereby avoiding the need for the luminary to be connected to an electrical power source (i.e., plugged into a standard home's power grid).

More generally, the present invention provides a support for a decorative item. The support includes a stanchion with a first end and a second end. A flexible neck, having a first end and a second end, is connected to the second end of the stanchion. The first end of the flexible neck is connected to the second end of the stanchion. At least one attachment device is disposed between the first and second end of the stanchion for attaching a decorative item to the stanchion. A luminary is connected to the second end of the flexible neck to provide illumination to the decorative item.

In one embodiment of the support of the present invention, the support includes a fitting disposed at the second end of the stanchion for connecting the first end of the flexible neck to the second end of the stanchion.

In another embodiment, the luminary includes a solar panel for collecting solar energy and converting the solar energy into electrical energy, a battery electrically connected to the solar panel to store the electrical energy, and a light source electrically connected to the battery and powered by the battery.

In still another embodiment, it is contemplated that the support may include a switch electrically connected between the light source and the battery for activating the light source.

With respect to the embodiment that incorporates a solar panel, the solar panel collects solar energy during daylight hours and converts the solar energy into electrical energy for storage in the battery.

It is contemplated that the battery may be a rechargeable battery.

In an embodiment of the support of the present invention, the decorative item may be a flag.

With respect to the luminary, the light source may include at east one light emitting diode.

Concerning the at least one attachment device, it is contemplated that the attachment device may be a hook. Alternatively, two or more hooks may be provided.

Still further, it is contemplated that the at least one attachment device may be a decorative item-carrying segment. If so, the decorative item-carrying segment may include a hook to retain the decorative item thereon.

In another contemplated embodiment of the support of the present invention, a footed base is provided at the first end of the stanchion. The footed base may be an L-shaped member connected adjacent to the first end of the stanchion.

It is contemplated that the support may be a flagpole.

It is also contemplated that the support may be made from metal. Possible metals include, but are not limited to, aluminum and steel. The metal may be covered with paint or a powder coating to reduce oxidation of the metal.

Other aspects of the invention will be made apparent from the discussion that follows.

BRIEF DESCRIPTION OF THE DRAWINGS

The present invention will now be described in connection with one or more figures in which.

DETAILED DESCRIPTION OF EMBODIMENT(S) OF THE INVENTION

The present invention will now be described in connection with one or more embodiments. While specific examples are discussed, the present invention is not intended to be limited to those examples. To the contrary, after understanding the present disclosure, those skilled in the art will appreciate that there are numerous equivalents and variations of the embodiments discussed herein that may be employed. The present invention is intended to encompass those equivalents and variations.

Figure 1:
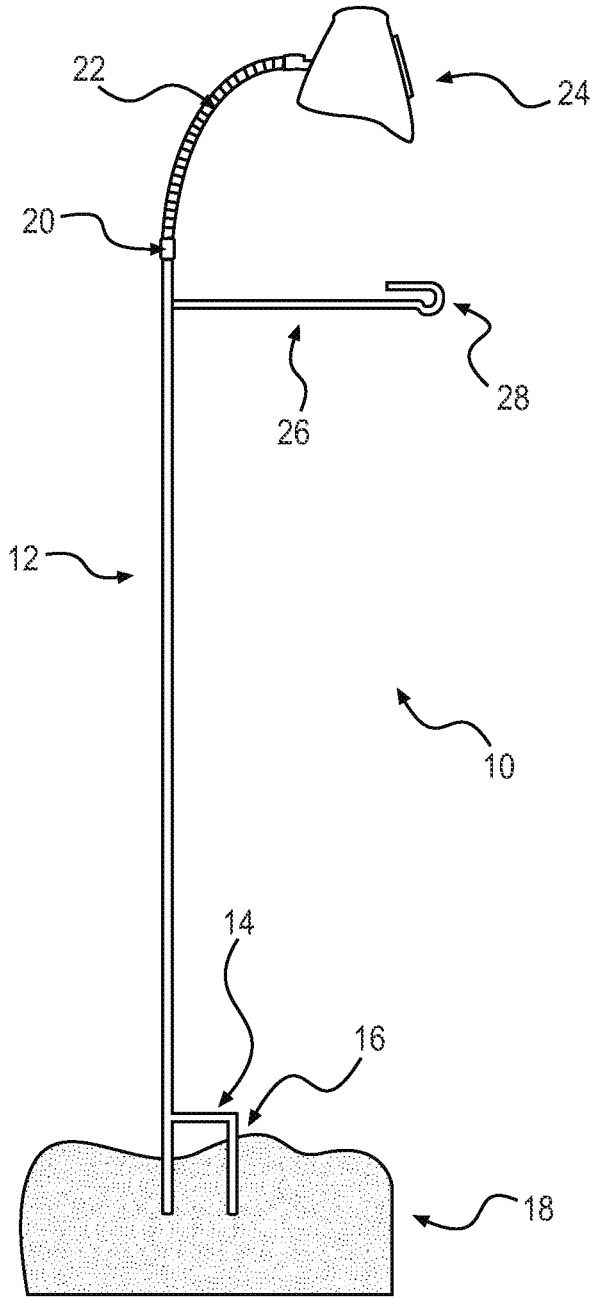
FIG. 1 is a schematic, side view of a first embodiment of a flagpole according to the present invention.

FIG. 1 is a side view schematic illustration of a first embodiment of a flagpole 10 according to the present invention. While the present invention will be described in connection its use as a flagpole 10, it is noted that the present invention may be used to support any other type of decorative item other than a flag. Accordingly, so that the present invention is not understood to be limited to carrying only a flag thereon, the present invention also is described as a support for an item, such as a decorative item. As should be apparent, any discussion of specific items, decorative or otherwise, that may be suspended from the support 10 of the present invention is not intended to be limiting of the present invention.

In a first embodiment, the support (hereinafter also referred to as a flagpole) 10 includes a stanchion 12 with a footed base 14 at a First end (or bottom end). The footed base 14 includes an L-shaped member 16 that extends therefrom. Together with the bottom end of the stanchion 12, the L-shaped member 16 permits the flagpole 10 to be secured in a horizontal surface, such as the ground 18.

At the top end (or second end) of the stanchion 12, the flagpole 10 includes a fitting 20 that connects the stanchion 12 with a flexible neck 22 with a first end connected to the fitting. A luminary 24 is connected to the second end of the flexible neck 22.

A decorative item-carrying segment 26 (i.e., a flag-carrying segment 26) extends from the stanchion 12 at a point near to the top (or second end) of the stanchion 12. The decorative item-carrying segment 26 may be welded to the stanchion. Alternatively, the segment 26 may be adhered to the stanchion 12 using an adhesive and/or fasteners. Other attachment means may be employed without departing from the scope of the present invention.

The segment 26 is a tubular member onto which a flag may be disposed. The segment 26 includes a hooked end 28 to discourage the inadvertent removal of a flag from the flagpole 10 (i.e., during a strong wind).

It is contemplated that each of the elements of the flagpole 10 will be fashioned from a suitable metal or metal alloy, such as aluminum or steel. In addition, it is contemplated that the metal components will be covered with paint or a powder coating to reduce oxidation (or rusting) of the metal. Alternatively, the elements of the flagpole 10 may be made from polyvinylchloride ("PVC"), polyethylene, or any other polymeric material. Still further, the flagpole 10 may be made from fiberglass and/or composite materials including, but not limited to, carbon fiber composite materials.

Figure 2:
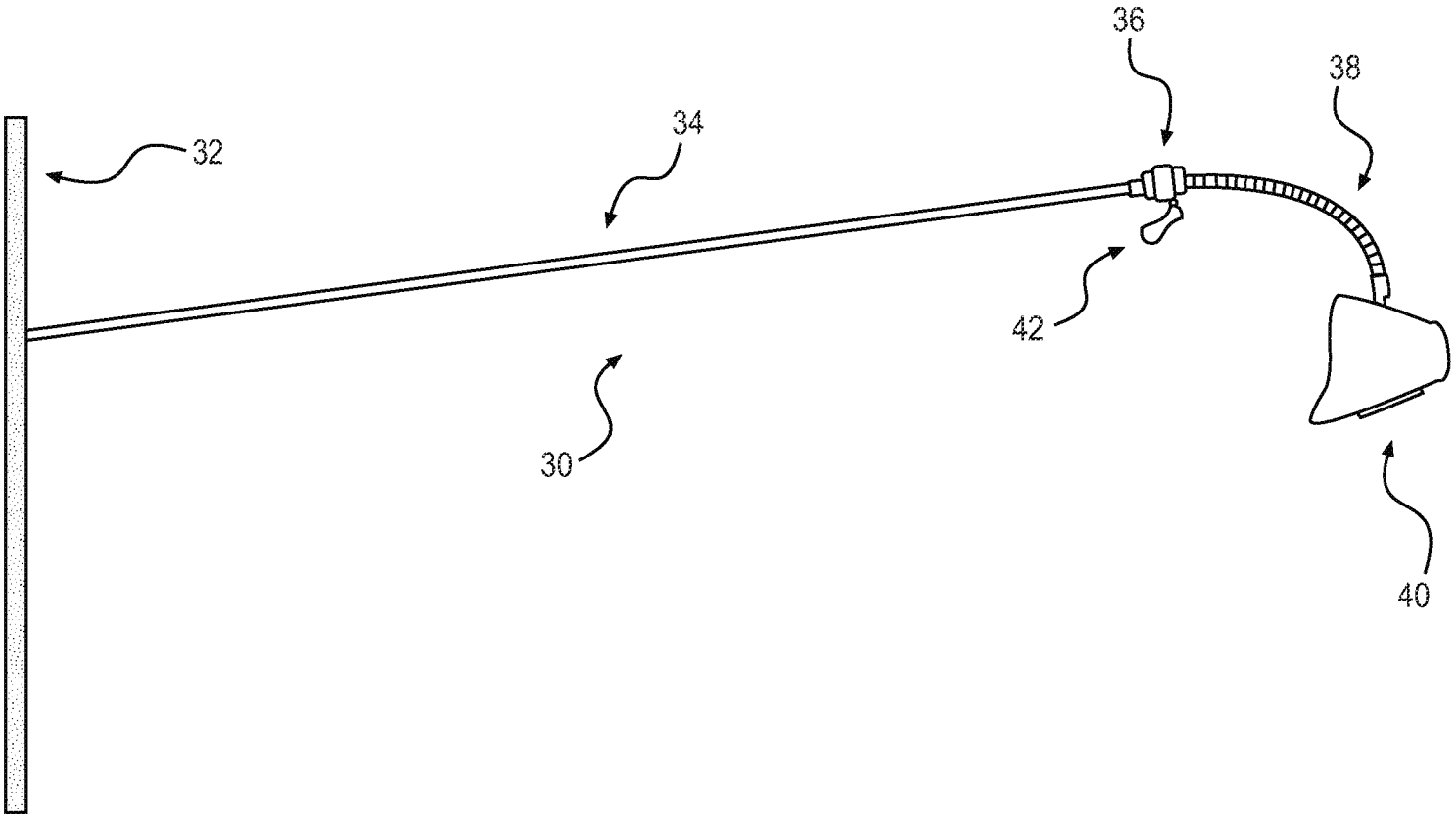
FIG. 2 is a schematic, side view of a second embodiment of a flagpole according to the present invention.

FIG. 2 is a side view schematic illustration of a second embodiment of a support or flagpole 30 according to the present invention. In this embodiment, the flagpole 30 is intended to be affixed or attached to a vertical surface 32, such as an exterior wall of a house, building, or other structure. In connection with this embodiment, it is noted that the vertical surface 32 need not be precisely vertical. An angled surface also is considered to fall within the scope of the present invention. For simplicity, the term "vertical surface" 32 is intended to encompass angled surfaces in addition to those that are entirely vertical (i.e., perpendicular to the ground or a horizontal surface)

The flagpole 30 includes a stanchion 34 that extends from the all 32 to a fitting 36. The fitting 36 connects the stanchion 34 to a flexible neck 38. A luminary 40 is disposed at the end of the flexible neck 38. A hook 42 (or other suitable attachment device) is provided on the stanchion 34 so that a flag or other decorative item may be attached to the stanchion 34. As noted above, while a flag is considered as one item to be supported by the support 10 of the present invention, the present invention should not be understood to be limited thereby.

As should be apparent to those skilled in the art, a plurality of hooks 42 may be provided without departing from the scope of the present invention. Specifically, it is contemplated that at least a second hook may be provided at a point between the fitting 36 and the vertical surface 32 to provide a second securement point for a flag or other decorative item suspended from the stanchion 34.

As should be apparent to those skilled in the art, the stanchion 32 may be affixed to the vertical surface 32 via any suitable means. For example, the stanchion 32 may be attached to a plate (not shown). The plate may be connected, in turn, to the vertical surface 32. Alternatively, the stanchion 32 may be fitted into a standard flag pole receiver (or similar support), attached to the vertical surface 32, as should be apparent to those skilled in the art.

Figure 3:
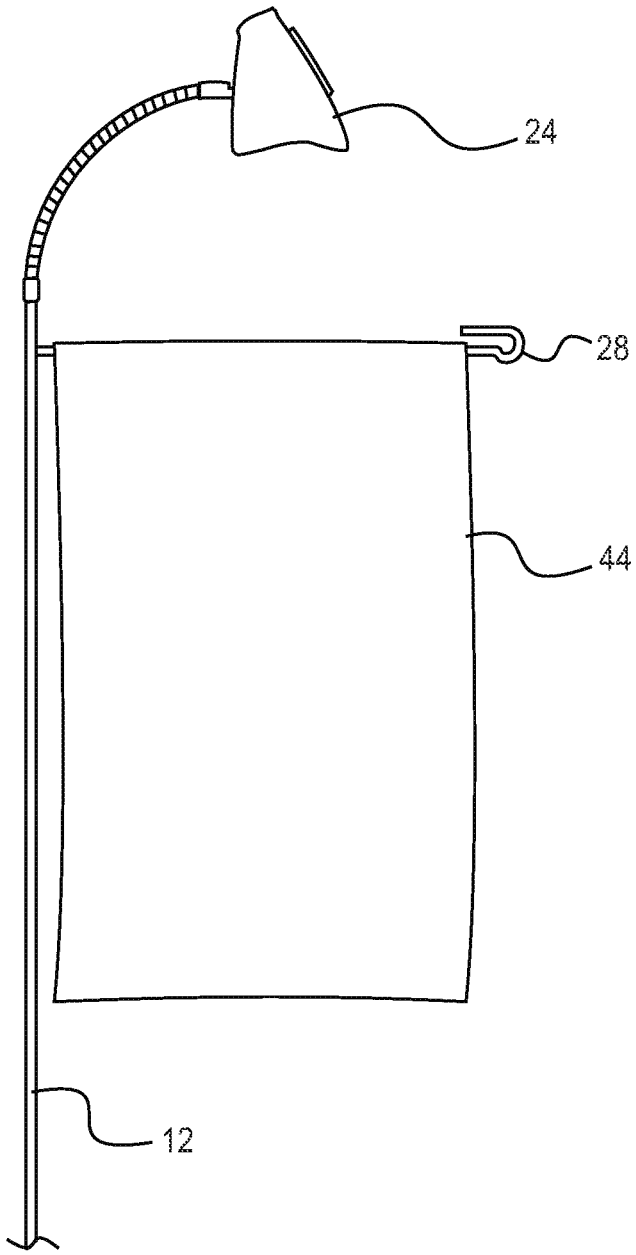
FIG. 3 is another illustration of the first embodiment of the flagpole of the present invention, showing a flag attached thereto.

FIG. 3 is a side view of the flagpole 10 illustrated in FIG. 1. A flag 44 is shown disposed on the flagpole 10 for purposes of illustration. As indicated, the flag 44 is one contemplated embodiment of the types of decorative items that may be suspended on the flagpole (or support) 10, 30 of the present invention.

Figure 4:
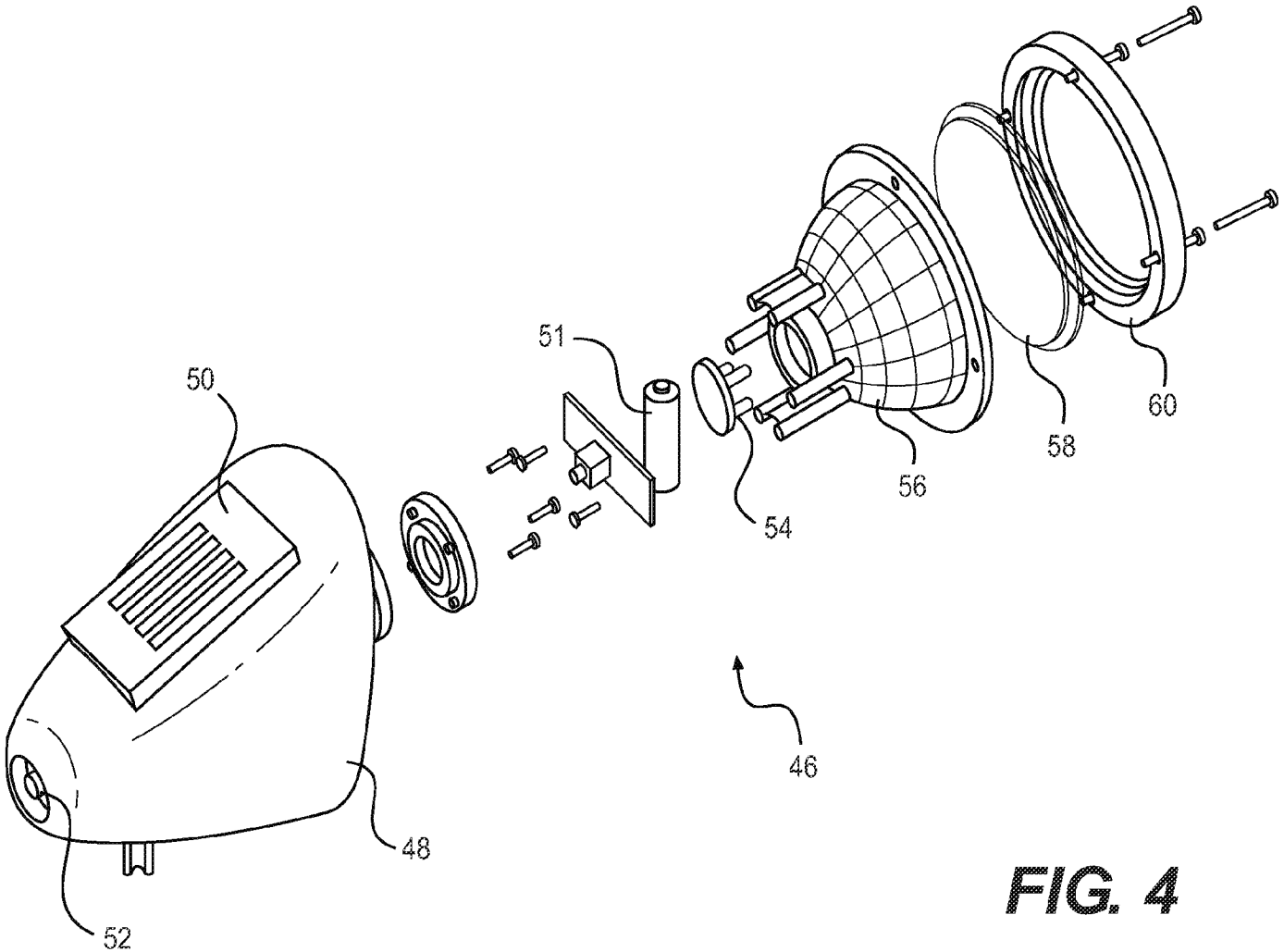
FIG. 4 is an exploded, perspective illustration of one contemplated embodiment of the luminary of the present invention.

FIG. 4 is an exploded, perspective illustration of a luminary 46 contemplated for use on the flagpoles 10, 30 discussed above. In other words, the luminary 46 is contemplated as either of the luminaries 24, 40 discussed above.

The luminary 46 includes an outer housing 48 with a solar panel 50 attached thereto (or embedded therein). It is contemplated that the solar panel 50 will convert solar energy into electrical energy during daylight hours and store the electrical energy in a rechargeable battery 51 disposed within the housing. When the luminary 46 is turned on, the battery 51 powers the luminary 46 until the battery 51 is depleted.

The housing includes a switch 52 that permits the luminary 46 to be turned on or off. The switch 52 is contemplated to be a push button switch, but any other type of switch 52 may be employed without departing from the scope of the present invention.

In connection with the switch 52, it is contemplated that additional electronics may be provide so that the luminary 46 is activated when ambient illumination reaches a certain minimum level. In this embodiment, after the switch 52 is activated to turn on the luminary 46, ambient conditions associated with sunset, for example, may activate the luminary without further manipulation by a person. Sunrise may deactivate the luminary 46.

In connection with the electronics, it is also contemplated that the luminary 46 may include a sensor to activate the luminary 46 in response to motion. A motion detector, if incorporated into the electronics, may act as an additional security feature.

The housing 48 includes a light source 54, which is contemplated to be a light emitting diode (or "LED") due to the low power consumption of this type of light source. So that light from the light source 54 is properly focused, a reflector 56 surrounds the light source 54. To protect the light source 54 from the elements, a lens 58 is provided over the reflector 56. An annular bracket 60 secures the lens 58 in the housing.

Figure 5:
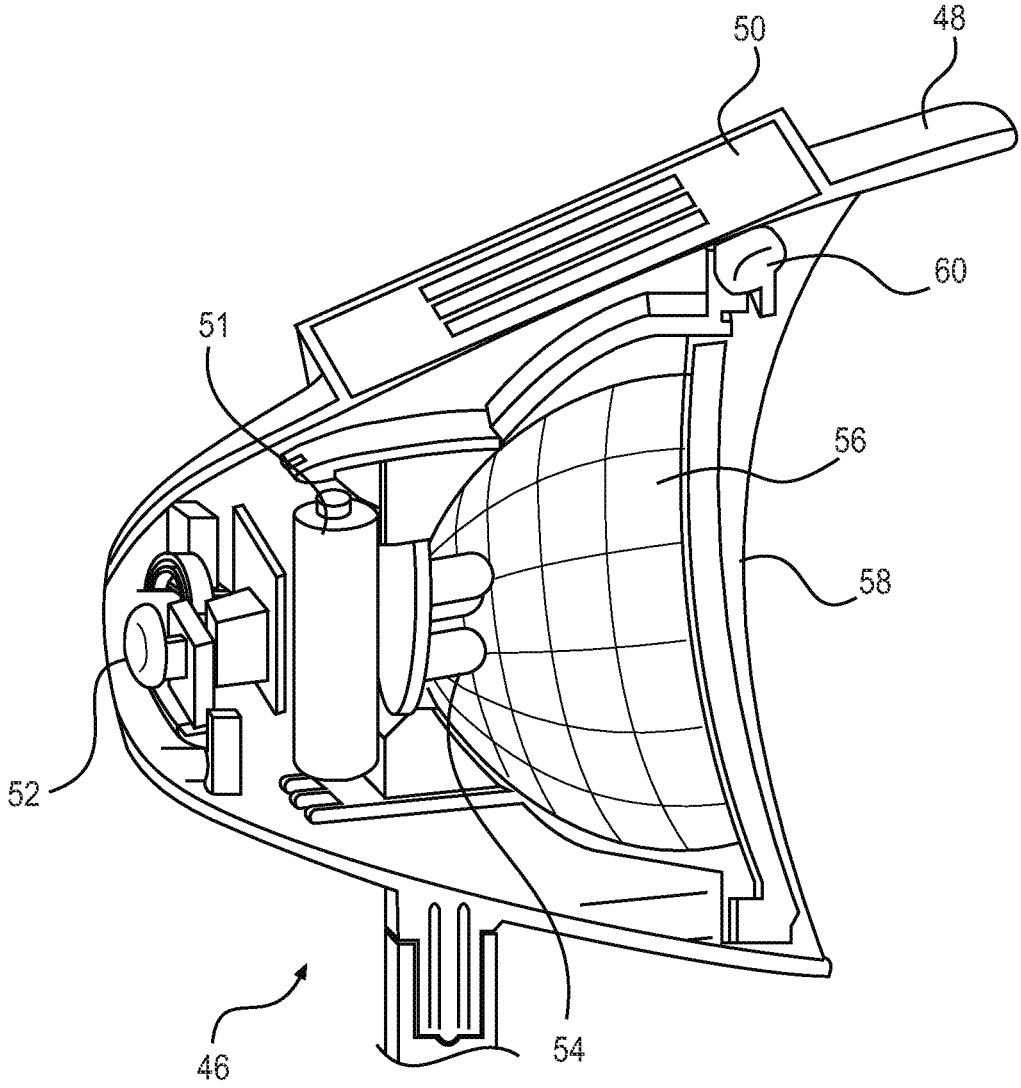
FIG. 5 is a cross-sectional illustration of the luminary illustrated in FIG. 4, with the luminary being shown in an assembled condition.

As illustrated in FIG. 5, the light source 54 may include a number of separate LEDs without departing from the scope of the present invention.

Other variations and equivalents may be appreciated by those skilled in the art. Those variations and equivalents are intended to be encompassed by the present invention.

What is claimed is:

1. A support for a decorative item, comprising:

a stanchion with a first end and a second end;

a flexible neck having a first end and a second end, the first end of the flexible neck being connected to the second end of the stanchion;

at least one attachment device that comprises at least one hook disposed between the first and second end of the stanchion for attaching a decorative item to the stanchion; and a luminary connected to the second end of the flexible neck to provide illumination to the decorative item.

2. The support of claim 1, wherein the at least one attachment device comprises two hooks disposed a predetermined distance from one another.

3. The support of claim 1, wherein the at least one attachment device comprises a decorative item-carrying segment.

4. The support of claim 3, wherein the decorative item-carrying segment comprises a bar with hook to retain the decorative item thereon.

5. The support of claim 1, wherein the luminary comprises:

a solar panel for collecting solar energy and converting the solar energy into electrical energy;

a battery electrically connected to the solar panel to store the electrical energy; and a light source electrically connected to the battery and powered by the battery.

6. A support for a decorative item, comprising:

a stanchion with a first end and a second end;

a flexible neck having a first end and a second end, the first end of the flexible neck being connected to the second end of the stanchion;

at least one attachment device disposed between the first and second end of the stanchion for attaching a decorative item to the stanchion;

a luminary connected to the second end of the flexible neck to provide illumination to the decorative item; and a footed base at the first end of the stanchion.

7. The support of claim 6, wherein the footed base comprises an L-shaped member connected adjacent to the first end of the stanchion.

8. The support of claim 6, wherein the luminary comprises:

a solar panel for collecting solar energy and converting the solar energy into electrical energy;

a battery electrically connected to the solar panel to store the electrical energy; and a light source electrically connected to the battery and powered by the battery.

9. A flagpole support for a decorative item, comprising:

a stanchion with a first end and a second end;

a flexible neck having a first end and a second end, the first end of the flexible neck being connected to the second end of the stanchion;

at least one attachment device disposed between the first and second end of the stanchion for attaching a decorative item to the stanchion; and a luminary connected to the second end of the flexible neck to provide illumination to the decorative item.

10. The support of claim 9, wherein at least the stanchion comprises metal.

11. The support of claim 10, wherein the metal comprises at least one of aluminum or an iron-containing alloy.

12. The support of claim 11, wherein the metal is covered with at least one of paint or a powder coating to reduce oxidation of the metal.

13. The support of claim 9, further comprising:

a fitting disposed at the second end of the stanchion for connecting the first end of the flexible neck to the second end of the stanchion.

14. The support of claim 9, wherein the luminary comprises:

a solar panel for collecting solar energy and converting the solar energy into electrical energy;

a battery electrically connected to the solar panel to store the electrical energy; and a light source electrically connected to the battery and powered by the battery.

15. The support of claim 14, further comprising:

a switch electrically connected between the light source and the battery for activating the light source.

16. The support of claim 14, wherein the solar panel collects solar energy during daylight hours and converts the solar energy into electrical energy for storage in the battery.

17. The support of claim 14, wherein the battery is a rechargeable battery.

18. The support of claim 14, wherein the light source comprises at least one light emitting diode.

* * * * *